US007444769B2

(12) United States Patent
Hall et al.

(10) Patent No.: US 7,444,769 B2
(45) Date of Patent: Nov. 4, 2008

(54) BOOT BINDING INTERFACE SYSTEM

(75) Inventors: Jake Hall, Draper, UT (US); Ben Walker, Draper, UT (US); David Mellon, Park City, UT (US); Mark Santurbane, Salt Lake City, UT (US); David Narajowski, Park City, UT (US)

(73) Assignee: Black Diamond Equipment, Ltd., Salt Lake City, UT (US)

( * ) Notice: Subject to any disclaimer, the term of this patent is extended or adjusted under 35 U.S.C. 154(b) by 0 days.

(21) Appl. No.: 11/930,566

(22) Filed: Oct. 31, 2007

(65) Prior Publication Data

US 2008/0104864 A1 May 8, 2008

Related U.S. Application Data

(60) Provisional application No. 60/864,210, filed on Nov. 3, 2006.

(51) Int. Cl.
*A43B 5/00* (2006.01)

(52) U.S. Cl. ..... 36/117.1; 36/117.2

(58) Field of Classification Search ..... 36/117.1, 36/117.2, 117.3, 131
See application file for complete search history.

(56) References Cited

U.S. PATENT DOCUMENTS

| | | | | |
|---|---|---|---|---|
| 5,066,036 | A * | 11/1991 | Broughton | 280/615 |
| 6,189,242 | B1 * | 2/2001 | Lin | 36/131 |
| 6,276,708 | B1 * | 8/2001 | Hogstedt | 280/613 |
| 6,289,610 | B1 * | 9/2001 | Girard et al. | 36/117.2 |
| 6,374,517 | B2 * | 4/2002 | Girard et al. | 36/117.3 |

* cited by examiner

*Primary Examiner*—Marie Patterson
(74) *Attorney, Agent, or Firm*—Trent H. Baker; Baker & Associates PLLC

(57) ABSTRACT

The present invention relates to a telemark ski boot system configured to enable efficient releasable rotatable coupling to a ski binding at a pivot location corresponding to the metatarsal region. One embodiment of the present invention related to a telemark ski boot system including a shell, a sole, and a binding interface system. The sole is coupled anatomically below the shell and includes a bottom sole surface defining the bottom most portion of the boot. The binding interface system is contained between the shell and bottom of the bottom sole surface and horizontally below the metatarsal region of the boot. In addition, the binding interface system is contained within the two dimensional footprint of the boot. Alternatively or in addition, the binding interface system is contained within the three dimensional space of the shell and sole. The binding interface system may be a rigid cleat.

21 Claims, 5 Drawing Sheets

BOOT BINDING INTERFACE SYSTEM

RELATED APPLICATIONS

This application claims priority to U.S. provisional application Ser. No. 60/864,210 filed Nov. 3, 2006, the contents of which are incorporated by reference.

FIELD OF THE INVENTION

The invention generally relates to athletic foot support to apparatus interfaces. In particular, the invention relates to a ski boot-binding interface and various methods of use and manufacture.

BACKGROUND OF THE INVENTION

A boot is a type of footwear that encases both the foot and a portion of the lower leg of a user. Boots are generally manufactured for a particular purpose or activity and therefore are designed to include characteristics consistent with the intended purpose. For example, a hiking boot is designed to support the ankle of a user while minimizing the overall weight. Likewise, a ski boot is designed to maximize a user's performance at a particular skiing activity.

Boots generally include a shell, a compression system, and a sole. The shell and compression system operate to encase and support the foot and lower leg of a user. Various well-known shell and compression systems are utilized to allow users to insert and remove their feet in an open boot configuration and compress the shell around the foot in a closed boot configuration. The sole of a boot is disposed on the bottom surface of the shell and sole is generally composed of a rubber or plastic material. The sole may consist of a single piece or multiple blocks. The stiffness and/or weight characteristics of the sole have an effect on the overall performance of the boot.

The general activity of skiing comprises many subset activities including but not limited to alpine touring, telemark, and downhill. Each subset of skiing generally corresponds to a unique system of specialized equipment. For example, the boot, ski, and binding systems used for telemark skiing are significantly different from those used for alpine touring. A skiing system may include standard types of boots, skis, and bindings. Each type of skiing also corresponds to unique characteristics of a boot to achieve optimal performance. In addition, particular terrain and skier preference may require an even more specific set of performance characteristics. Boots for particular skiing activities must be compatible with the remainder of the system. For example, telemark skiing boots have generally been required to conform to the 75 mm standard to allow for compatibility with telemark type bindings.

Telemark skiing requires that a user be able to pivot or rotate their foot with respect to the corresponding ski in the metatarsal foot bone region. Most conventional telemark boot binding interface systems utilize an extended sole portion called a duckbill to couple the boot to the binding and ski. The proper rotational freedom is then controlled by the flexibility properties of the boot and duckbill. This system requires that the duckbill and toe region of the boot be sufficiently rigid to prevent undesired rotation or torsion about the duckbill. This required rigidity necessitates relatively heavy materials for both the duckbill and toe portion of the boot. In addition, this duckbill boot binding interface creates a toe-biased pivot that is difficult to adjust without also affecting undesired movements such as torsion.

Therefore, there is a need in the industry for a boot binding interface system that enables releasable rotatable coupling while minimizing weight and optimizing telemark performance.

SUMMARY OF THE INVENTION

The present invention relates to a telemark ski boot system configured to enable efficient releasable rotatable coupling to a ski binding at a pivot location corresponding to the metatarsal region. One embodiment of the present invention related to a telemark ski boot system including a shell, a sole, and a binding interface system. The shell is configured to encase and support a user's foot upon on interior footbed. The sole is coupled anatomically below the shell and includes a bottom sole surface defining the bottom most portion of the boot. The binding interface system is contained between the shell and bottom of the bottom sole surface and horizontally below the metatarsal region of the boot. In addition, the binding interface system is contained within the two dimensional footprint of the boot. Alternatively or in addition, the binding interface system is contained within the three dimensional space of the shell and sole. The binding interface system may be a rigid cleat. The binding interface system further includes a shell coupling system and a binding rotational coupling system. The binding interface system, sole, and shell may be portions of a single manufactured boot component or may be coupled to one another via various shell coupling systems. For example, the shell coupling system may utilize a sandwich coupling so as to distribute coupling forces across the shell material. In addition, the binding interface system and/or the sole may be releasable with respect to the shell in order to enable replacement and/or system modularity. The binding rotational coupling system includes two rotational couplers disposed on the lateral sides with respect to the anatomical orientation of the shell.

Embodiments of the present invention represent a significant advancement in the field of telemark ski boots. Containing a binding interface system within the three dimensional space of a shell minimizes spacing between a user's foot and ski thereby increasing performance. In addition, the containment of the binding interface system enables greater non-skiing performance of the ski boots by providing for a more stable platform for walking. Further, the positioning of the binding interface system at the metatarsal region of the boot as opposed to the toe region improves telemark downhill skiing performance. Various other significant advantages of this technology over prior art will be described below.

These and other features and advantages of the present invention will be set forth or will become more fully apparent in the description that follows and in the appended claims. The features and advantages may be realized and obtained by means of the instruments and combinations particularly pointed out in the appended claims. Furthermore, the features and advantages of the invention may be learned by the practice of the invention or will be obvious from the description, as set forth hereinafter.

BRIEF DESCRIPTION OF THE DRAWINGS

The following description of the invention can be understood in light of the Figures, which illustrate specific aspects of the invention and are a part of the specification. Together with the following description, the Figures demonstrate and explain the principles of the invention. The Figures presented in conjunction with this description are views of only particular—rather than complete—portions of the systems and methods of making and using the system according to the invention. In the Figures, the physical dimensions may be exaggerated for clarity.

DETAILED DESCRIPTION OF THE INVENTION

Figure 1:
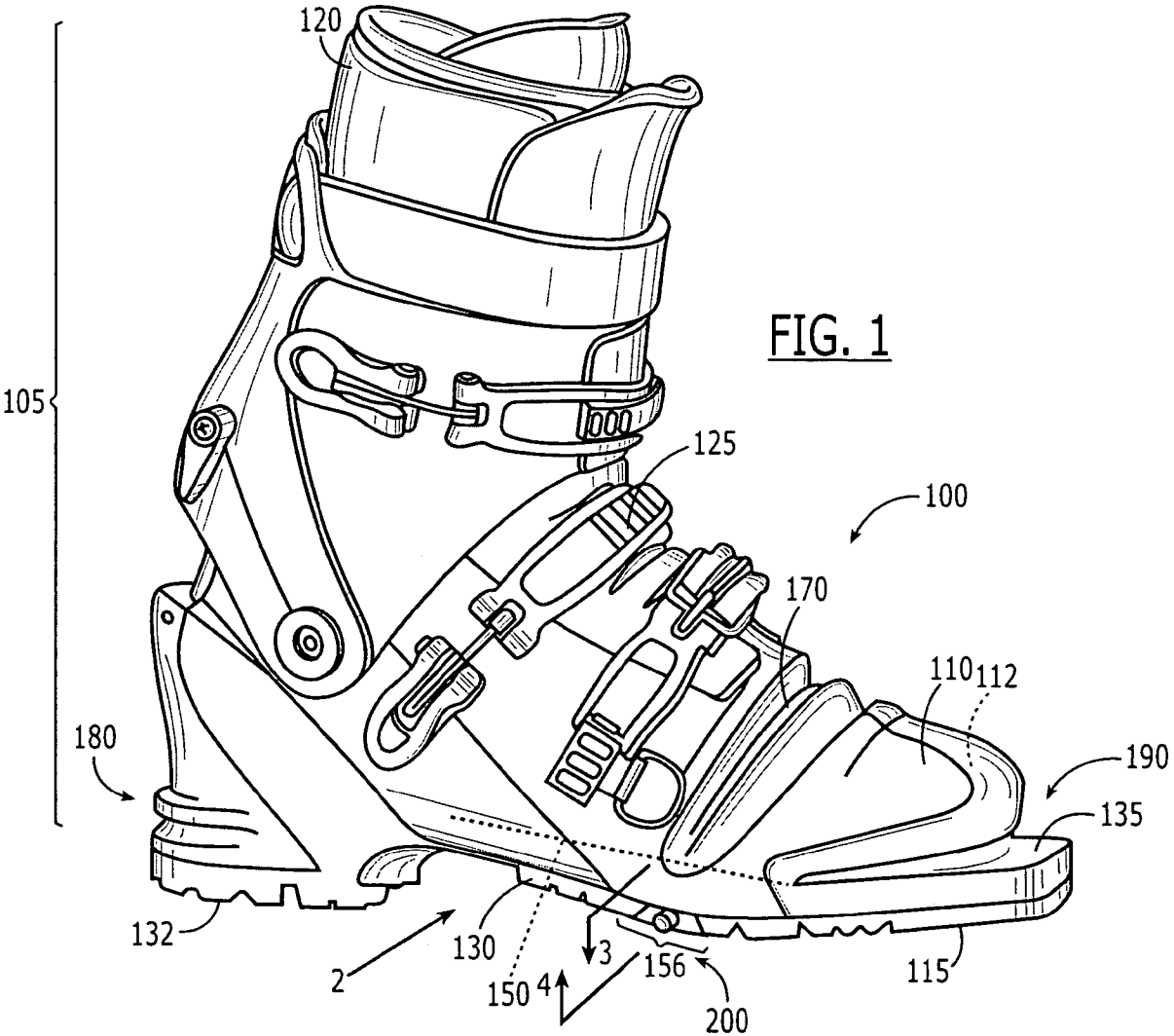
FIG. 1 illustrates a perspective view of a telemark ski boot system in accordance with one embodiment of the present invention including identified orientations 2, 3, and 4.

The present invention relates to a telemark ski boot system configured to enable efficient releasable rotatable coupling to a ski binding at a pivot location corresponding to the metatarsal region. One embodiment of the present invention related to a telemark ski boot system including a shell, a sole, and a binding interface system. The shell is configured to encase and support a user's foot upon on interior footbed. The sole is coupled anatomically below the shell and includes a bottom sole surface defining the bottom most portion of the boot. The binding interface system is contained between the shell and bottom of the bottom sole surface and horizontally below the metatarsal region of the boot. In addition, the binding interface system is contained within the two dimensional footprint of the boot. Alternatively or in addition, the binding interface system is contained within the three dimensional space of the shell and sole. The binding interface system may be a rigid cleat. The binding interface system further includes a shell coupling system and a binding rotational coupling system. The binding interface system, sole, and shell may be portions of a single manufactured boot component or may be coupled to one another via various shell coupling systems. For example, the shell coupling system may utilize a sandwich coupling so as to distribute coupling forces across the shell material. In addition, the binding interface system and/or the sole may be releasable with respect to the shell in order to enable replacement and/or system modularity. The binding rotational coupling system includes two rotational couplers disposed on the lateral sides with respect to the anatomical orientation of the shell. While embodiments of present invention are described in reference to a telemark boot system, it will be appreciated that the teachings of present invention are applicable to other areas.

The following terms are defined as follows:

Boot—a device configured to house and support a user's foot according to specific parameters. For example, a telemark ski boot may enable a user to articulate the boot in the metatarsal and ankle regions while minimizing lateral or torsional articulation.

Binding—a device used to couple a user's foot to an athletic apparatus. For example, a ski binding may be used to releasably couple a boot to a ski. Certain bindings maintain a user's ability to move their foot with respect to the apparatus according to specific geometries. For example, a telemark ski binding may allow a boot to rotate with respect to the ski about the front of the boot and/or the metatarsal region of the boot.

Binding interface system—a system configured to enable the releasable coupling with a binding. For example, conventional telemark boots included a duckbill interface protruding from the front of the boot for purposes of releasable attachment to a binding. Embodiments of the present invention include an alternative novel binding interface system.

Sole—a portion or component of a boot disposed on the bottom under a user's foot. The sole may be composed of rigid or flexible materials and may include a tread pattern on the bottom-most surface. The composition and tread of the sole may be designed for purposes including walking, dampening, maximizing friction, etc.

Footprint—a two dimensional continuous shape defining the two dimensional expanse of the bottom region of a boot. For example, the shape of the imprint of the bottom most surface of a boot.

Metatarsal region—a region of a boot corresponding to the location at which the metatarsal bones of a user's foot are disposed when wearing the boot. The metatarsal bones of the foot correspond to the location of the ball of the foot.

Shell—a portion or component of a boot configured to house or encase a user's foot and optionally a portion of the user's lower leg. A boot shell may be composed of one or more materials and layers having a plurality of thicknesses and properties, for example plastic, leather, metal, and/or fabric.

A binding interface system—a mechanical system configured to couple a boot to a binding so as to achieve various supportive and operational characteristics.

Cleat—a rigid member configured to couple to both a boot and a binding. For example, a bicycle cleat attaches a user's shoe to a pedal. The coupling between the cleat and the shoe may be fixably coupled, while the coupling between cleat and the binding may be releasably coupled.

Ski—any type of elongated snow supporting apparatus including but not limited to an alpine ski, cross country ski, telemark ski, snowboard, snowshoe, etc.

Sole—the lowest portion of a boot configured to engage between the shell and a supportive surface in a non-ski configuration.

Footprint—a two dimensional region corresponding to the area defined by the lowest surface of a boot. For example, a footprint may correspond to the indentation resulting from exerting a downward force upon a boot onto a supportive surface.

Footbed—an interior region of a shell corresponding to the surface above which a user's foot is disposed.

Metatarsal region—a region of a boot corresponding to the anatomical location at which a user's metatarsal bones are disposed.

Reference is initially made to FIG. 1, which illustrates a perspective view of a telemark ski boot system in accordance with one embodiment of the present invention, designated generally at 100. The telemark ski boot system 100 includes generally a shell 105, an inner boot 120, a plurality of clamping mechanisms 125, a sole 115, 130, 132, and a binding interface system 200. The shell 105 further includes a heel portion 180, a toe portion 190, a duckbill 135, an upper pivot region 150, an interior surface 112, an exterior surface 110, a lower shell portion 150 (for purposes of cutaway illustration), a shell bottom 160 (see FIG. 2), and a footbed (see FIG. 2). The sole includes a front sole 115, a rear sole 130, and a heel sole 132. As is well known in the industry, various components of the shell 105, sole 115, 130, 132, and/or the binding interface system 200 may be manufactured as a single component and/or oriented to produce the same characteristics as if they were separate. The binding interface system 200 is illustrated and described in more detail with reference to FIGS. 2-4. Telemark ski boot systems are distinguishable from other ski boots in that they are configured to enable the heel portion 180 of the boot 100 to pivot about an anatomical metatarsal region 156. The upper pivot region 150 allows the shell material positioned within the metatarsal region 156 to bend in the manner necessary for use as a telemark ski boot. Embodiments of the present invention relate to incorporation of a novel binding interface system 200 with a telemark ski boot and may therefore be integrated with various alternative shell and sole designs.

With continued reference to FIG. 1, the binding interface system 200 is positioned within the metatarsal region 156 of the ski boot system 100 to coordinate the anatomical pivot location of a foot with a rotational coupling between the ski boot system 100 and a ski binding (not shown). It will be noted that the upper pivot location 150 is also positioned within the metatarsal region 150. Various notches and recesses in the shell bottom 160 and/or sole 115, 130, 132 may be used to accommodate the binding interface system 200. One of the novel features of embodiments of the present invention is the containment of the binding interface system 200 with respect to the space defined by the shell 105 and the sole 115, 130, 132. In the illustrated embodiment, the binding interface system 200 is contained within the three dimensional space defined by the shell 105 and the sole 115, 130, 132. Therefore, the binding interface system 200 does not extend laterally beyond the two dimensional expanse of the sole 115, 130, 132 (referred to as the "footprint" 140 in reference to FIG. 4) or vertically beyond the shell bottom 160 or sole 115, 130, 132. In addition, the shell 105 and sole 115, 130, 132 configuration of the illustrated embodiment allows for direct anatomical lateral access to the binding interface system 200. This three dimensional containment and direct lateral access provides numerous functional advantages to the illustrated boot system 100 over existing technology. For example, spacing between a user's foot and ski is minimized, thereby increasing responsiveness. Likewise, non-skiing usability of the boot system 100 is enhanced by maintaining a level sole 115, 130, 132 platform upon which a user may walk. And further, debris accumulation on the binding interface system 200 is minimized because of its contained positioning relative to the supporting surface of the boot system 100. It will also be noted that the illustrated boot system 100 embodiment includes an unobstructed duckbill 135 and therefore is compatible with conventional telemark type binding systems that couple to the duckbill 135.

Figure 2:
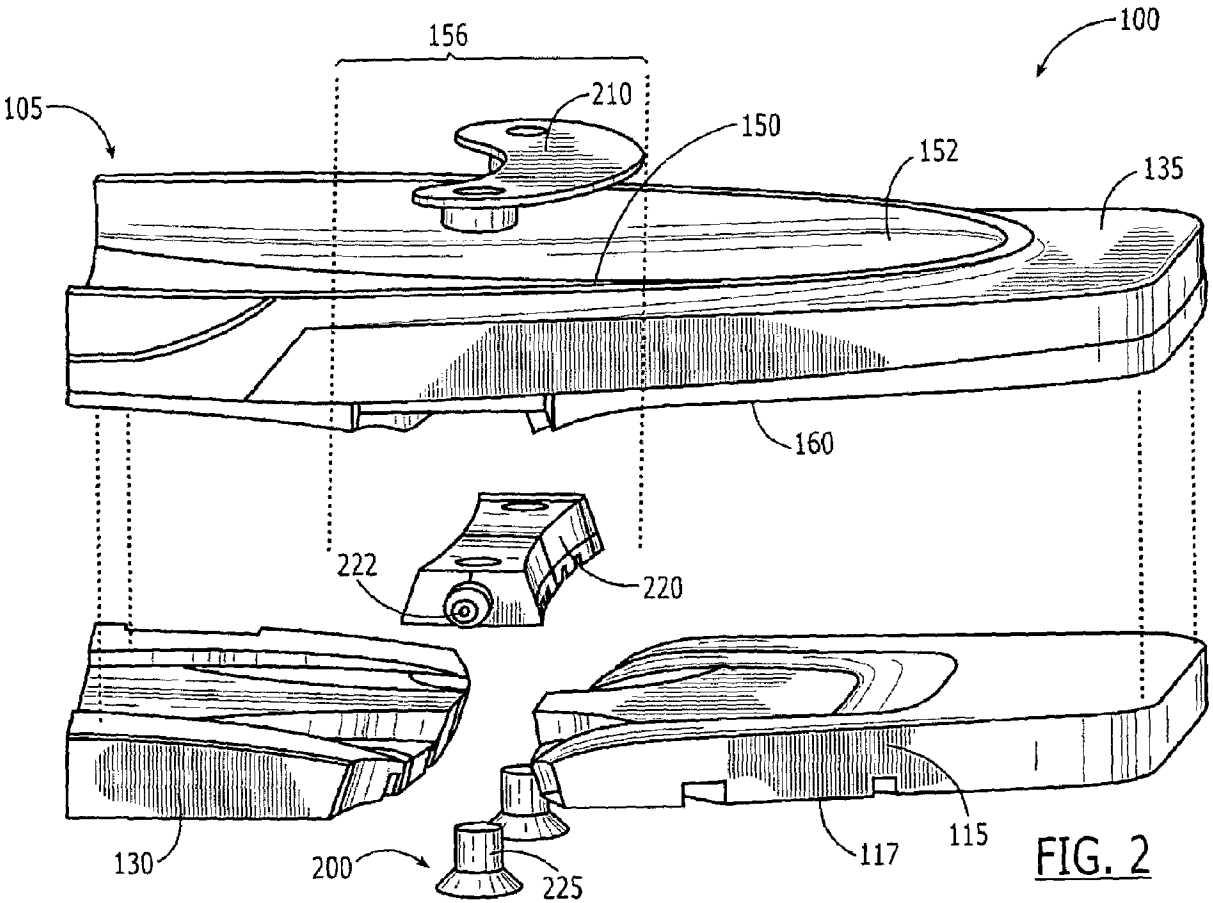
FIG. 2 illustrates a cutaway exploded view of a portion of the telemark ski boot system illustrated in FIG. 1 from the perspective of the dashed region designated as 2.

Reference is next made to FIG. 2, which illustrates a cutaway exploded perspective view of a portion of the telemark ski boot system illustrated in FIG. 1 from the perspective of the dashed arrow designated as 2. The shell 105 is cutaway along the dashed line in FIG. 1, indicating the lower shell portion 150 to help illustrate the relative positioning of the binding interface system 200 and the respective components. The footbed 152 of the shell 105 is the inner region of the shell upon which a user's foot is disposed and/or supported. The footbed 152 is generally a recessed region to support the user's foot three dimensionally. The front sole 115 and rear sole 130 portions are illustrated as being disposed on opposite lengthwise sides of the binding interface system 200. Alternatively, the front and rear sole portions 115, 130 may be disposed over and/or between the binding interface system 200. As described above, the components of the binding interface system 200 are contained within the metatarsal region 156. The binding interface system 200 generally includes a shell coupling system and a binding rotational coupling system. The shell coupling system facilitates a rigid coupling between the binding rotational coupling system and the shell 105.

The illustrated shell coupling system utilizes a sandwich type coupling configuration designed to distribute coupling forces across the shell 105 material to prevent damage and allow for lightweight shell materials. The shell coupling system of the binding interface system 200 includes a cleat 220, a shell plate 210, and a plurality of couplers 225. The shell plate 210 is positioned above the footbed 152, the cleat 220 is positioned below the shell bottom 160, and the plurality of couplers 225 extend through the cleat 220 and into the shell plate 210. The shell plate 210 is two dimensionally laterally sized according to the material properties of the shell bottom 160 so as to efficiently distribute forces across the shell bottom 160. Likewise, the shell plate 210 is vertically shaped to fit within a footbed recess 154 (see FIG. 3) of the footbed 152. The shell plate 210 is also composed of a sufficiently rigid material to minimize movement when coupled to the cleat. The shell plate 210 further includes a plurality of coupling receiving recesses, such as bosses, for engagement with the plurality of couplers 225. The cleat 220 is three dimensionally shaped in an elongated manner to provide a lateral surface upon which the binding rotational coupling system is disposed on either lateral side. The cleat 220 included two holes through which the plurality of couplers 225 may extend for purposes of the sandwich/compression coupling. Various other curvatures and geometries may be includes to optimize the positional interface between the cleat 220 and the shell bottom 160 and/or front and rear sole 115, 130 portions. The couplers 225 may be any type of male coupling mechanism such as screws or rivets. The illustrated embodiment of a shell coupling system has the added benefit of being releasable to enable modularity and/or replacement.

Alternatively, the shell coupling system of the binding interface system 200 may utilize a key-lock type coupling system or an integrated molding type coupling system. A key-lock type binding coupling system may include a cleat which mechanically engages with the shell bottom 160 using a locking mechanical structure well known in the industry, for example a translational slotted ball and socket type connector. These connector shapes may be integrally molded into the cleat and/or shell bottom. Likewise, an integrated molding type coupling system would include manufacturing the cleat as a portion of the shell bottom 160. Various modifications to an injection molding process could be utilized in conjunction with multiple materials to produce similar binding coupling characteristics and cleat geometry.

The illustrated binding rotational coupling system of the binding interface system 200 includes two male pin type connectors 222 disposed on opposite lateral sides of the cleat 220. The male pin type connectors 222 may facilitate a rotational type coupling between the boot system 100 and a binding that includes corresponding female recess type connectors (not shown). The positioning of the binding rotational coupling system 222 with respect to the shell bottom 160 and sole 115, 130 enables direct anatomical lateral access to the male pin type connectors 222, further facilitating a rotational type coupling. Various shaped male type connectors may be utilized to include both rotational curvatures and lateral notches that enable further engagement with a telemark binding system. Alternatively, it will be appreciated that the male pin type connectors 222 could be replaced with female type recessed connectors for engagement with male type pin connectors disposed on a telemark ski binding. Likewise, any other rotational type mechanical connector could be disposed on the cleat 220 in accordance with embodiments of the present invention.

Figure 3:
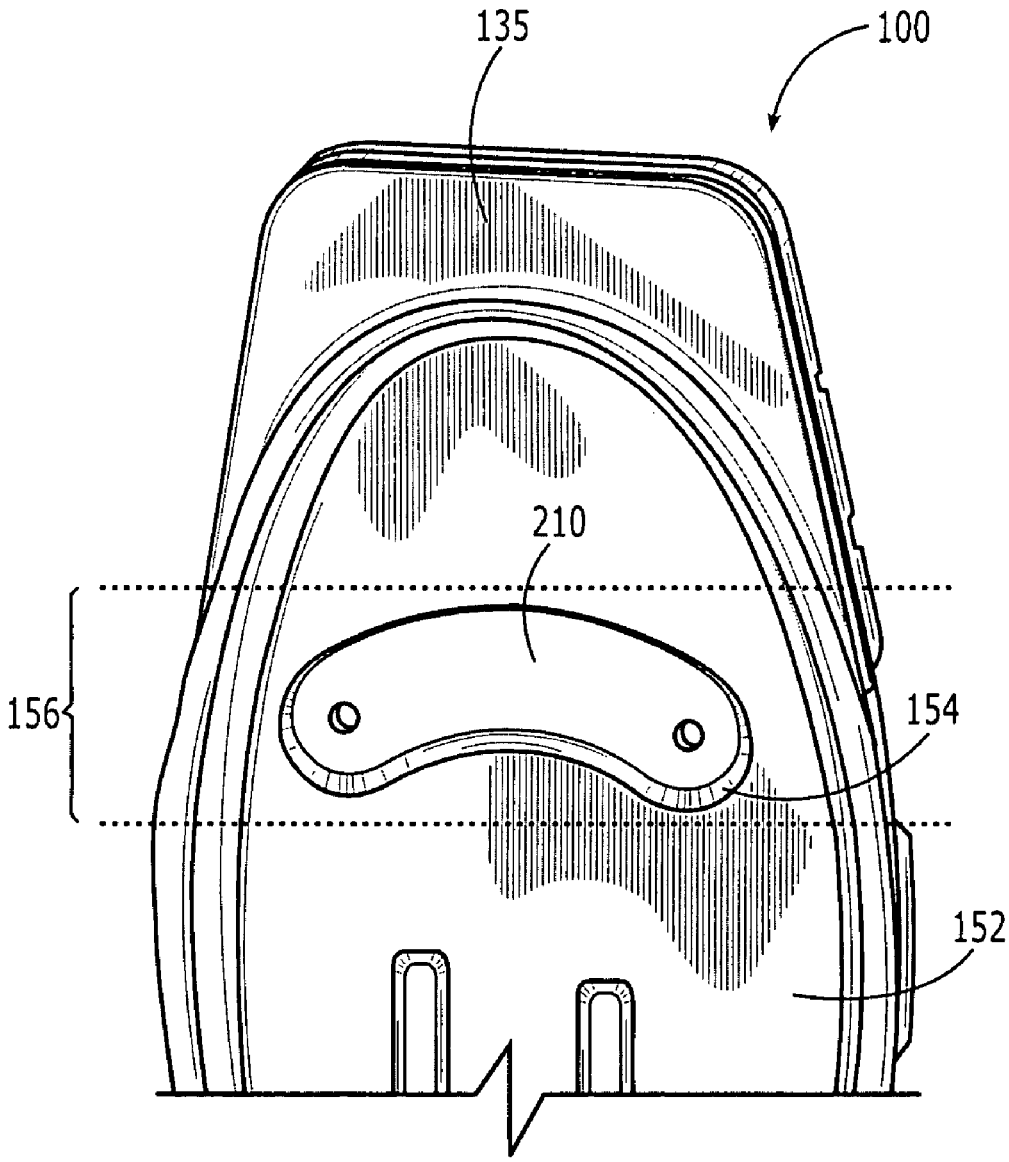
FIG. 3 illustrates a cutaway elevational view of a portion of the telemark ski boot system illustrated in FIG. 1 from the perspective of the dashed region designated as 3.

Reference is next made to FIG. 3, which illustrates a cutaway elevational view of a portion of the telemark ski boot system illustrated in FIG. 1 from the perspective of the dashed region designated as 3. Again, the shell 105 is cutaway along the dashed line in FIG. 1 to only show the lower shell portion 150. The footbed recess 154 provides a vertical region for the shell plate 210 such that the shell plate 210 does not anatomically rise above the supportive surface of the footbed 152. The shell plate 210 may be vertically lower than the footbed 152 by extending into the footbed recess 154 as illustrated. The coupling recesses of the shell plate 210 are disposed on lateral extremities of the shell plate 210 for purposes of optimal coupling and force distribution. The shell plate 210 is only accessible via the footbed 152 of the shell 105 and may be covered by some type of orthopedic footbed and/or liner.

Figure 4:
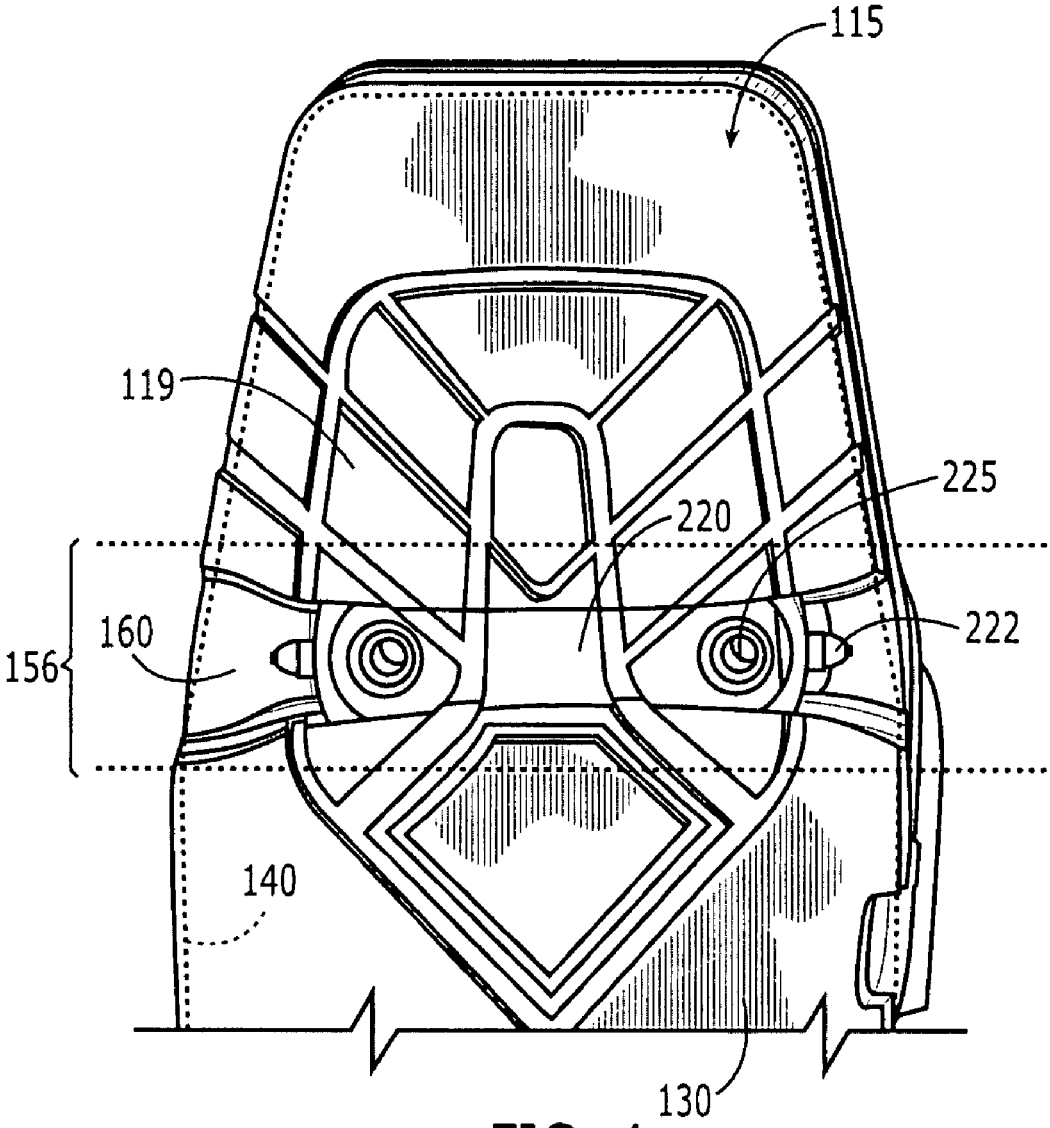
FIG. 4 illustrates a lower view of a portion of the telemark ski boot system illustrated in FIG. 1 from the perspective of the dashed region designated as 4.

Reference is next made to FIG. 4, which illustrates a lower view of a portion of the telemark ski boot system illustrated in FIG. 1 from the perspective of the dashed region designated as 4. The positioning of the binding interface system 200 within the metatarsal region 156 and within the footprint 140 of the boot system 100 is further illustrated. As mentioned above, the footprint 140 is defined as the two dimensional region or perimeter defined by the lower surface of the boot system 100, namely the sole 115, 130. The binding interface system 200 is directly laterally accessible meaning the male pin type connectors 222 may be accessed from a direct lateral engagement without any form of support or structure extending below the sole 115, 130 or bottom most surface of the boot system 100. In the illustrated embodiment and perspective, the shell bottom 160 is visible on either side of the binding interface system 200 but may alternatively be covered by a sole portion extending between the front and rear sole 115, 130. A sole tread pattern 119 is also disposed on the bottom surface of the front and rear sole 115, 130 portions to facilitate increased frictional resistance in a non-skiing application of the boot system 100.

In one alternative non-illustrated embodiment of the present invention, the boot binding interface system may extend vertically or horizontally beyond the elevational or lateral dimensions of the boot. For example, the cleat portion may protrude below the bottom surface of the sole and the rotatable connectors may extend laterally beyond the sides of the boot sole and shell. By extending the cleat below the bottom surface of the sole, the reliability of the releasable coupling with the binding may be increased. Likewise, the lateral extension of the rotatable couplers may enable improved rotatable coupling. For example, if the boot system is obstructed during rotation due to the location of the rotatable couplers, it may be necessary to extend beyond the footprint of the boot.

Figure 5:
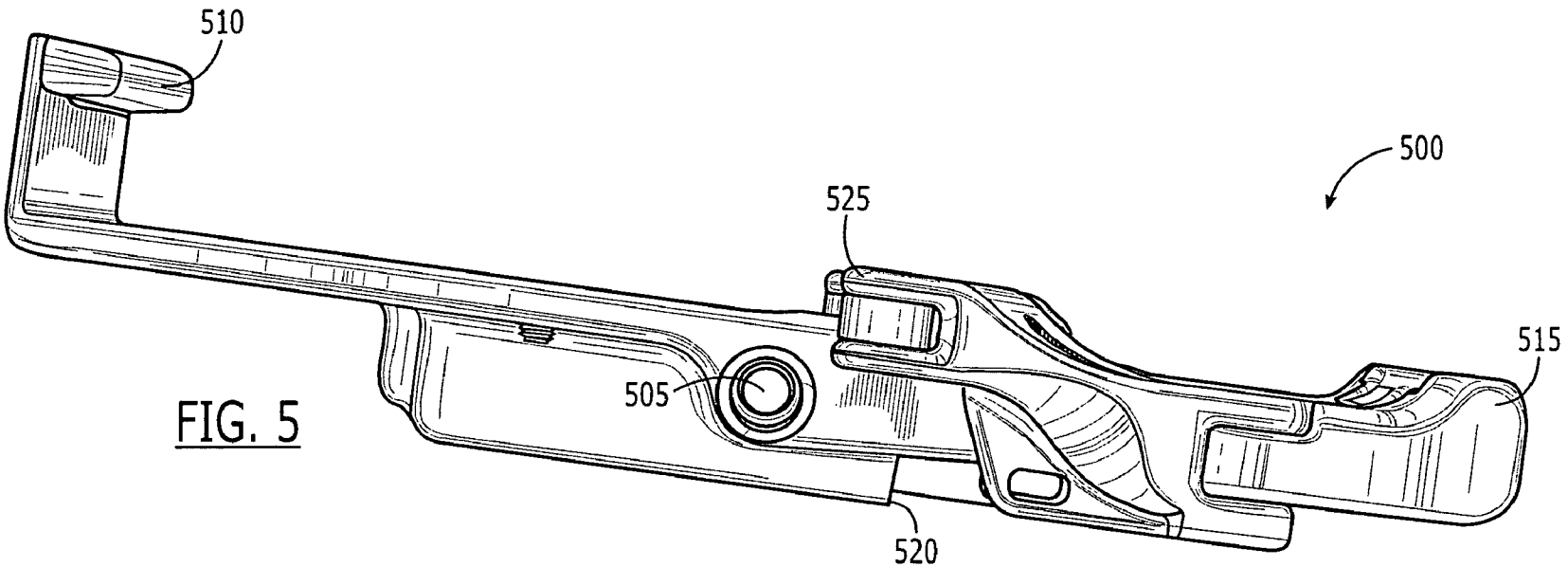
FIG. 5 illustrates an alternative optional extension portion of a binding interface system in accordance with an alternative embodiment of the present invention.

Reference is next made to FIG. 5, which illustrates an optional lower portion of a binding interface system in accordance with an alternative embodiment of the present invention, designated generally at 500. The lower portion 500 further includes a pair of rotatable binding couplers 505, a front sole attachment 515, a rear sole attachment 510, a cleat attachment 525, and a lower surface 520. The extension portion 500 may be coupled to a similar cleat type member as described in reference to FIGS. 1-4. However, in the suggested alternative configuration, the rotatable coupling system portion of the binding interface system is disposed on the lower portion 500 rather than the cleat. The lower portion 500 is confined within the footprint of the lower sole surface but may extend below the lower sole surface. The lengthwise orientation of the lower portion 500 with respect to the remainder of the system (not shown) is configured such that the rotational coupling system is within the metatarsal region. In the illustrated lower portion 500, the rotational coupling system includes the two rotatable binding couplers 505. The illustrated lower portion 500 is couplable to the remainder of the system via the front sole attachment 515, rear sole attachment 510, and the cleat attachment 525. It will be appreciated that various alternative coupling configurations may be utilized and remain consistent with the teachings of the present invention.

Various other embodiments have been contemplated including combinations in whole or in part of the embodiments described above. Including embodiments directed at but not limited to utilizing female rotatable couplers on the cleat, insert molding multiple components together, etc.

What is claimed is:

1. A telemark ski boot system comprising:

a shell shaped to substantially enclose an internal region corresponding to the shape of a human foot, wherein the shell includes an interior and exterior surface, and wherein the interior surface includes a footbed within the internal region, and wherein the shell includes a metatarsal region corresponding to the lengthwise region at which the metatarsal bones of an enclosed human foot are disposed, and wherein the exterior surface includes a shell bottom externally corresponding to the location of the footbed, and wherein the exterior surface further includes an upper pivot region opposite the shell bottom and configured to enable a heel region of the shell to pivot about the metatarsal region;

a sole coupled to the shell bottom having a bottom sole surface, wherein the bottom sole surface is the lowest elevational surface of the telemark ski boot system when oriented in an upright configuration corresponding to an anatomical upright human oriented leg and foot, and wherein the bottom sole surface includes a footprint corresponding to the two dimensional perimeter of the bottom sole surface; and a binding interface system coupled to the shell bottom at a lengthwise location corresponding to the metatarsal region, wherein binding interface system is contained between the footbed and the bottom sole surface, and wherein the binding interface system is contained within the footprint of the bottom sole surface, and wherein the binding interface system includes a shell coupling system and a binding rotational coupling system, wherein the binding rotational coupling system includes two rotatable couplers disposed relative to the sole and shell to enable direct lateral access.

2. The telemark ski boot system of claim 1, wherein the shell coupling system comprises:

a shell plate elevationally disposed on the footbed of the shell;

a cleat elevationally disposed below the shell bottom, wherein the cleat is fixably disposed relative to the metatarsal region; and a plurality of couplers extending through the cleat, the shell, and the shell plate.

3. The telemark ski boot system of claim 2, wherein the shell plate is disposed within an elevational recess of the footbed corresponding to the thickness of the shell plate.

4. The telemark ski boot of claim 2, wherein the cleat is coupled directly to the shell bottom.

5. The telemark ski boot system of claim 2, wherein the sole includes a front sole and a rear sole portion and wherein the cleat is lengthwise disposed between the front and rear sole portions.

6. The telemark ski boot system of claim 2, wherein the rotational coupling system includes two rotatable couplers laterally disposed on the cleat.

7. The telemark ski boot system of claim 6, wherein the rotatable couplers include at least one of a male pin and a female recess.

8. The telemark ski boot system of claim 1, wherein the rotatable couplers include at least one of a male pin and a female recess configured for rotatable engagement with a corresponding ski binding.

9. The telemark ski boot system of claim 1, wherein the shell coupling system and binding rotational coupling system include a cleat rigidly coupled to the shell with respect to the metatarsal region.

10. The telemark ski boot system of claim 9, wherein the cleat is rigidly coupled to the shell via a key lock engagement system.

11. The telemark ski boot system of claim 9, wherein the cleat is manufactured as a single integrated structure with the shell utilizing a composition configured to create a rigid positioning relative to the metatarsal region.

12. The telemark ski boot system of claim 9, wherein the cleat is an elongated rigid member disposed widthwise relative to the shell and wherein the binding rotational coupling system further includes two rotatable couplers disposed on the lengthwise sides of the cleat.

13. The telemark ski boot system of claim 12, wherein the rotatable couplers include at least one of a male pin and a female recess configured for rotatable engagement with a corresponding ski binding.

14. A telemark ski boot system comprising:

a shell shaped to substantially enclose an internal region corresponding to the shape of a human foot, wherein the shell includes an interior and exterior surface, and wherein the interior surface includes a footbed within the internal region, and wherein the shell includes a metatarsal region corresponding to the lengthwise region at which the metatarsal bones of an enclosed human foot are disposed, and wherein the exterior surface includes a shell bottom externally corresponding to the location of the footbed, and wherein the exterior surface further includes an upper pivot region opposite the shell bottom and configured to enable a heel region of the shell to pivot about the metatarsal region;

a sole coupled to the shell bottom;

a binding interface system coupled to the shell bottom at a lengthwise location corresponding to the metatarsal region, wherein binding interface system is contained within the three dimensional space of the shell and sole, and wherein the binding interface system includes a shell coupling system and a binding rotational coupling system;

wherein the shell coupling system comprises:

a shell plate disposed on the footbed of the shell;

a cleat elevationally disposed below the shell bottom, wherein the cleat is fixably disposed relative to the metatarsal region;

a plurality of couplers extending through the cleat, the shell, and the shell plate; and wherein the binding rotational coupling system comprises two rotational couplers disposed on the cleat so as to be directly externally laterally accessible in relation to the shell and sole.

15. The telemark ski boot system of claim 14, wherein the two rotational couplers include one of a male pin and a female recess configured for rotatable engagement with a corresponding ski binding.

16. The telemark ski boot system of claim 14, wherein the sole includes a front and rear sole portion coupled to the shell bottom and disposed on opposite lengthwise sides of the cleat.

17. A telemark ski boot system comprising:

a shell shaped to substantially enclose an internal region corresponding to the shape of a human foot, wherein the shell includes an interior and exterior surface, and wherein the interior surface includes a footbed within the internal region, and wherein the shell includes a metatarsal region corresponding to the lengthwise region at which the metatarsal bones of an enclosed human foot are disposed, and wherein the exterior surface includes a shell bottom externally corresponding to the location of the footbed, and wherein the exterior surface further includes an upper pivot region opposite the shell bottom and configured to enable a heel region of the shell to pivot about the metatarsal region;

a sole coupled to the shell bottom having a bottom sole surface, wherein the bottom sole surface is the lowest elevational surface of the telemark ski boot system when oriented in an upright configuration corresponding to an upright anatomical human oriented leg and foot, and wherein the bottom sole surface includes a footprint corresponding to the two dimensional perimeter of the bottom sole surface; and wherein the shell includes a cleat disposed on the shell bottom at a lengthwise location corresponding to the metatarsal region, wherein the cleat is contained between the footbed and the bottom sole surface, and wherein the cleat is contained within the footprint of the bottom sole surface, wherein the cleat further includes two rotational couplers laterally disposed with respect to the shell.

18. The telemark ski boot system of claim 17, wherein the two rotational couplers include one of a male pin and female recess configured for rotatable engagement with a corresponding ski binding.

19. The telemark ski boot system of claim 17, wherein the two rotational couplers are externally laterally accessible with respect to the sole.

20. A telemark ski boot system comprising:

a shell shaped to substantially enclose an internal region corresponding to the shape of a human foot, wherein the shell includes an interior and exterior surface, and wherein the interior surface includes a footbed within the internal region, and wherein the shell includes a metatarsal region corresponding to the lengthwise region at which the metatarsal bones of an enclosed human foot are disposed, and wherein the exterior surface includes a shell bottom externally corresponding to the location of the footbed, and wherein the exterior surface further includes an upper pivot region opposite the shell bottom and configured to enable a heel region of the shell to pivot about the metatarsal region;

a sole coupled to the shell bottom having a bottom sole surface, wherein the bottom sole surface includes a footprint corresponding to the two dimensional perimeter of the bottom sole surface; and wherein the shell includes a cleat disposed on the shell bottom at a lengthwise location corresponding to the metatarsal region, wherein the cleat is contained between the footbed and the bottom sole surface, and wherein the cleat is contained within the footprint of the bottom sole surface, wherein the cleat is coupled to a lower extension portion which extends below the bottom sole surface but is contained within the footprint, wherein the lower extension portion further includes two rotational binding couplers laterally disposed with respect to the shell and lengthwise disposed within the metatarsal region.

21. The telemark ski boot system of claim 20, wherein the coupling between the cleat and the lower portion is releasable.

* * * * *